United States Patent [19]

Schneider

[11] Patent Number: 4,823,599

[45] Date of Patent: Apr. 25, 1989

[54] METHOD OF OPERATING A MACHINE FOR THE STRESS RELIEF OF WORKPIECES BY VIBRATION

[76] Inventor: Dietmar Schneider, Am Unterfeld 2, 6229 Schlagen bad-Georgenborn, Fed. Rep. of Germany

[21] Appl. No.: 97,212

[22] Filed: Sep. 15, 1987

[30] Foreign Application Priority Data

Sep. 26, 1986 [EP] European Pat. Off. ..... 86113278.5

[51] Int. Cl.[4] ..... G01N 29/00

[52] U.S. Cl. ..... 73/579; 148/12.9

[58] Field of Search ..... 73/577, 579, 580, 581, 73/582, 583, 662, 667; 148/12.9

[56] References Cited

U.S. PATENT DOCUMENTS

| | | | |
|---|---|---|---|
| 3,677,831 | 7/1972 | Pezaris et al. | 73/579 |
| 3,741,820 | 6/1973 | Hebel, Jr. et al. | 148/12.9 |
| 4,001,053 | 1/1977 | Igisu | 148/12.9 |
| 4,381,673 | 5/1983 | Klauba et al. | 73/579 |
| 4,402,222 | 9/1983 | Olson et al. | 73/579 |
| 4,446,733 | 5/1984 | Okubo | 73/579 |

FOREIGN PATENT DOCUMENTS 7005792 2/1970 Fed. Rep. of Germany .

2088269 6/1982 United Kingdom .

OTHER PUBLICATIONS

Tried vibratory stress relief? by Stanley R. Rich., American Machinist Apr. 8, 1968.

*Primary Examiner*—Tom Noland
*Assistant Examiner*—Louis M. Arana
*Attorney, Agent, or Firm*—Darby & Darby

[57] ABSTRACT

Method for operating a machine for the relaxation of workpieces, in which the workpiece is subjected to vibrations of selected speeds of a vibrator and in which the selection of the speeds of the vibrator is taken from a measurement which reproduces the vibratory behavior of the workpiece upon excitation by the vibrator within its operating range and in which, for the individual speeds of the vibrator within its operating range, there are determined within a defined harmonics region those harmonics corresponding to those vibrations in the operating range in which resonances or similar stable states of vibration occur and in which connection, for the relaxation of the workpiece, there are selected those speeds which are causal for an accumulating of harmonics in the defined harmonics region.

12 Claims, 2 Drawing Sheets

METHOD OF OPERATING A MACHINE FOR THE STRESS RELIEF OF WORKPIECES BY VIBRATION

BACKGROUND OF THE INVENTION

The present invention relates to a machine for the stress relief of workpieces in which the workpiece is subjected to vibrations at selected speeds of a vibrator and in which the selection of the speeds of the vibrator is taken from a measurement which reproduces the vibratory behavior of the workpiece upon excitation by the vibrator.

A method of stress relief by vibration is described in detail in Federal Republic of Germany utility model 70 05 792 or U.S. Pat. No. 3,677,831. For the stress relieving of workpieces one customarily operates with vibrator speeds of 1200 to 6000 rpm or even up to 12,000 rpm, which corresponds to exciter frequencies of 20 to 100 Hz and 200 Hz respectively. In performing the method one first determines in a measurement run over this operating range, those speeds or frequencies at which the workpiece tends towards strong vibrations which indicate resonate frequencies. The vibratory behavior is generally determined by an accelerometer which is fastened on the workpiece. For stress relief, the workpiece is then subjected to treatment by the vibrator at the speeds at which the workpiece showed resonant frequencies in the preceding measurement run. In the case of workpieces of complicated structure, there are generally so many peaks or maxima in the acceleration value/speed diagram that it is necessary to make a selection of the speeds of the vibrator for the stress relief treatment, in which case one ordinarily picks out only those speeds having clearly pronounced vibration peaks. Not infrequently, the case arises that some of the clearly pronounced peaks represent only harmonic oscillations of a fundamental frequency, so that in the case of those frequencies, stress relief treatment is unnecessary if one has already operated at the corresponding fundamental frequency. In addition, precisely those frequencies which are essential for the stress relief are frequently so poorly pronounced in the workpiece, which has still not been stress relieved, that they are not selected in the acceleration-value/speed diagram during the search for strongly pronounced peaks. It is known, to be sure, that the internal stresses which lie in the microscopic region are not relieved directly by the operating frequencies of the vibrator, but by the harmonics thereof. However, up to now one relied on a clearly pronounced peak occurring in the measurement run upon excitation of such a harmonic which is also within the operating range of the vibrator. Frequently, however, such peaks remain poorly pronounced and are not detected upon the selection of the strongly pronounced vibration peaks, as a result of which the actual stress relief of the workpiece generally remains far below the optimal level.

SUMMARY OF THE INVENTION

The object of the present invention is to provide a method of operating a vibration machine in which the optimal degree of stress relief of a workpiece can be approached closer than with previous methods.

This object is achieved in that, for the individual speeds of the vibrator within its operating range (for instance, 1200 to 6000 rpm or 20 to 1000 Hz), there are determined within a defined harmonics region (for instance 100 to 2000 Hz) the harmonics corresponding to those vibrations in the operating range in which resonance or similar stable states of vibration occur. Then, for stress relief of the workpiece, there are selected those speeds of the vibrator within its operating range which cause a concentration of harmonics in the defined harmonics region.

The present invention is based on the discovery that the distribution of the harmonics of the vibrations (which are propagated within a workpiece as a result of the vibrator excitation) gives substantially better information as to which exciter frequencies of the vibrator within its operating region to use for stress relief than do the peaks which occur in the operation region itself. Workpieces need not be of very complicated structure in order to show a large number of stable states of vibration which lie far outside the frequency range within which the vibrator is operated. By analysis of the harmonics region for the individual vibrator speeds in which the workpiece tends towards stable vibrations, information is obtained as to what vibrator speeds lead to concentration of vibrations in the harmonics region and what operating speeds of the vibrator are essential for stress relief. There are to be considered essential those operating vibrations of the vibrator which lead to the largest possible number of excitations in the harmonics region.

For the determination of the concentration of harmonics in the defined harmonics region one can proceed along two different paths. According to one such path, the resonances or similar stable states of vibration in the operating range of the vibrator and the harmonics corresponding to the peaks in vibration behavior are established by calculation. From these calculated harmonics values it is then determined which of the values from the operating range of the vibrator cause a concentration of harmonics.

According to an alternative path, the harmonics are determined by measurement. In this case one can use the customary methods of frequency analysis after exciting the workpiece (for instance, via the vibrator) with continuously increasing speed or small speed steps of a well-defined blow on the workpiece, in order to impart the harmonic vibrations.

In a preferred further development of the method, the amplitudes of the measured harmonics are used as additional criterion for selection. The higher the amplitude, the better suited the operating frequency corresponding to said harmonic for vibrational stress relief. In one embodiment of the method according to the present invention the concentration of the harmonics is correlated with the corresponding amplitude, for instance multiplied by it, in order to effect the selection from the diagram which is thus obtained.

A preferred further development, which leads to a further optimizing of the selection of the speeds of the vibrator for the relaxation, can be used both for the calculated determination of the harmonics and for the determination thereof by measurement. This further development of the method is particularly suitable for evaluation by a computer. According to this development the harmonics region is divided into adjacent windows of a well-defined bandwidth of, for instance, 7 Hz each, and a direct indication is obtained of the frequency ranges in which harmonics occur in a concentrated fashion. Since the statistical distribution of the harmonics within the harmonics region is not uniform, but has a maximum at relatively low values, one obtains an improved prediction with regard to the concentration of harmonics when the result of the distribution of the harmonics, which is associated with the workpiece, is compared with a statistical distribution in order to determine in what harmonics regions there is a concentration of harmonics, as compared with the statistical distribution.

A still further development according to the invention leads to an even better optimization of the selection of the speeds of the vibrator. According to this embodiment not only is a concentration of harmonics in the harmonic region taken into account but, in addition, the selection of frequencies is also effected on basis of the criterion that those speeds of the vibrator are preferred which excite the largest number of harmonic regions with concentrations of harmonics.

The method of the present invention also involves selection of the speeds for the vibrator stress relief from the sequence of speeds which have supplied the largest number of selected window regions with harmonics.

In contradistinction to the selection based on the number of harmonics in selected window regions, the selection criterion may be based on only those harmonics which result from speeds of the vibrator which have not already been selected. Therefore, in each case a speed is selected and the selected window regions are then reestablished. Since those harmonics which belong to the speed which has already been selected are no longer taken into account, any window regions which may have been previously selected are disregarded. Thus, in each case the next operating speed of the vibrator is selected from the remaining or the newly selected window regions with harmonics.

There are different possibilities for determining the measurement diagram from which the harmonics are determined. In actual practice, the acceleration/speed diagram has customarily been used up to now. Upon excitation of the workpiece by the vibrator, at least one accelerometer is attached to the workpiece for the detection of the vibration behavior. This accelerometer indicates relatively well the frequency at which the preferred vibrations of the workpiece lie. Instead of such an acceleration/speed diagram, one can also use an amplitude/speed diagram or a distortion-factor/speed diagram. The distortion-factor/speed diagram has the advantage that it does not show, like the acceleration/speed diagram, a quadratic rise with increasing frequencies but, aside from the peaks contained therein, has a course which is constant with the speed.

BRIEF DESCRIPTION OF THE DRAWINGS

The invention will be described below on the basis of the diagrams shown in the drawing, in which.

DESCRIPTION OF THE PREFERRED EMBODIMENTS

Figure 1:
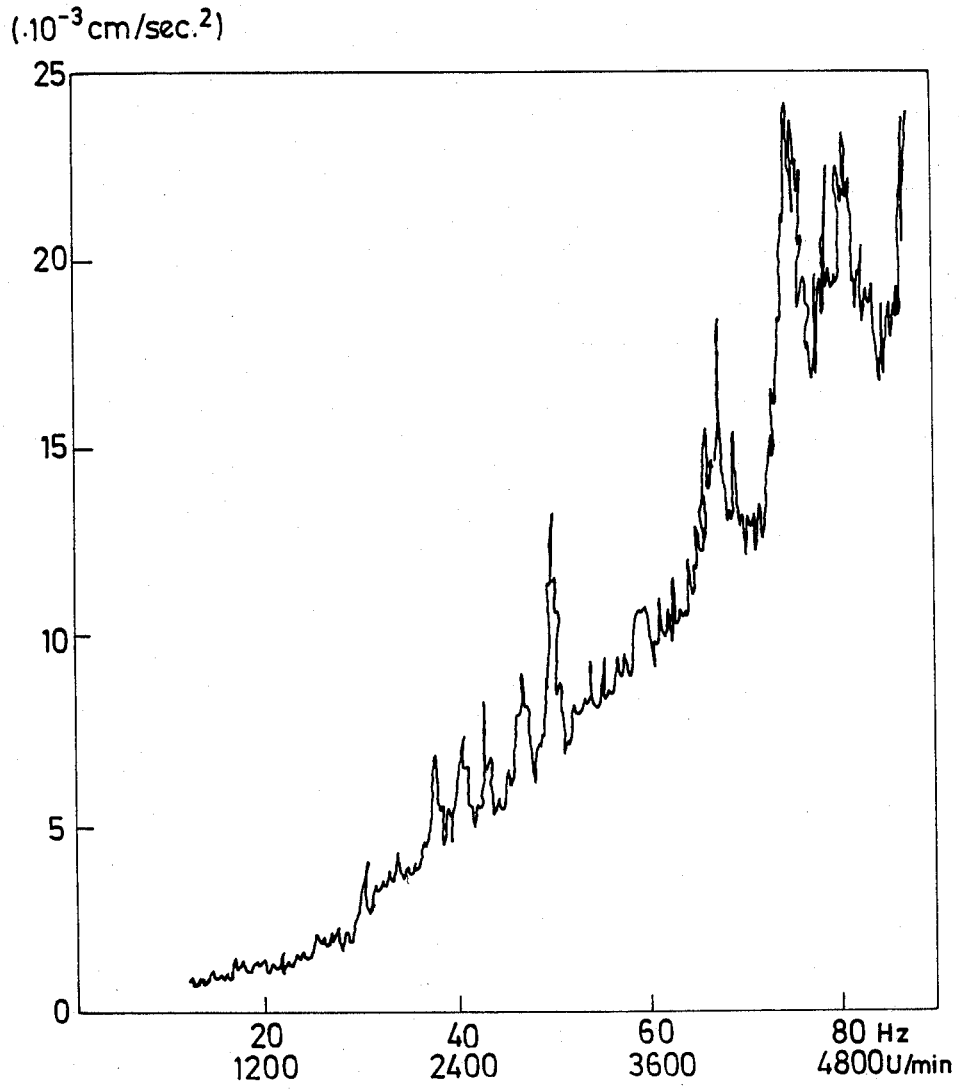
FIG. 1 is an example of an acceleration/speed diagram of a workpiece.

FIG. 1 is a typical acceleration/speed diagram of a workpiece over a speed range of 1200 to 4800 rpm. This diagram shows a large number of maxima or peaks of increased acceleration values with the corresponding speed. These peaks need not necessarily be due to resonance vibrations at the frequency of the excitation by the vibrator, if the accelerometer is also sensitive to higher frequencies. In such a case, the accelerometer also measures accelerations of vibrations with frequencies outside the operating range. It can definitely happen that, while the workpiece vibrates only insignificantly at the excitation frequency of, for instance, 40 Hz, the accelerometer nevertheless shows a relatively high value. This is an indication that the workpiece vibrates strongly at the harmonics produced at 40 Hz.

Figure 2A:
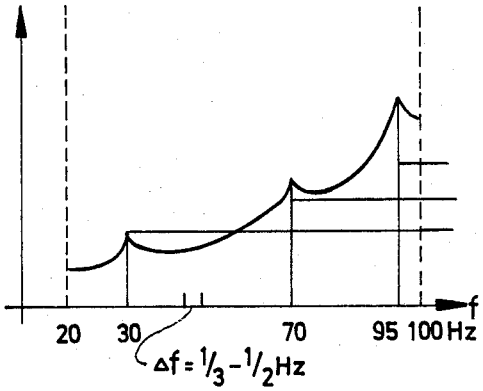
FIGS. 2a–2b is a simplified diagram of an acceleration/speed diagram with associated harmonics diagram.

FIG. 2a shows a greatly simplified acceleration/speed diagram corresponding to FIG. 1. In the preferred embodiment described here of the method of the invention, this diagram is first of all plotted. To form this plot the workpiece is placed in vibration by the vibrator and the speed of the vibrator is increased. The acceleration-response behavior is recorded in the form of this diagram. In the embodiment described here, the vibrator is actuated, starting with a speed of 1200 rpm and increases up to 6000 rpm in steps of 20 to 30 rpm, and the corresponding acceleration value is recorded in each case. In the simplified diagram of FIG. 2a, three peaks or maxima are determined at 30 Hz, 70 Hz and 95 Hz. With this acceleration/speed diagram, there is associated the harmonics diagram shown in FIG. 2b, in which a harmonics region of 100 Hz to 2000 Hz is defined. For all the peaks determined in the acceleration/speed diagram or the corresponding excitation frequencies, the harmonics are now calculated, the excitation frequency being multiplied by, in each case, progressive integers for the calculation of the harmonics. For the example assumed here of peaks in the acceleration/speed diagram at 30 Hz, 70 Hz and 95 Hz, the following harmonics result in the defined harmonics diagram of 100 Hz to 2000 Hz:

| | |
|---|---|
| 30 Hz × 2 = | 60 Hz (invalid, since not in the defined harmonics region) |
| 30 Hz × 3 = | 90 Hz |
| 30 Hz × 4 = | 120 Hz |
| 30 Hz × 5 = | 150 Hz |
| 30 Hz × 6 = | 180 Hz |
| 30 Hz × 7 = | 210 Hz |
| 30 Hz × 8 = | 240 Hz |
| 30 Hz × 9 = | 270 Hz |
| 30 Hz × 10 = | 300 Hz |
| 30 Hz × 11 = | 330 Hz |
| 30 Hz × 12 = | 360 Hz |
| 30 Hz × 13 = | 390 Hz |
| 30 Hz × 14 = | 420 Hz |
| 30 Hz × 15 = | 450 Hz |

Figure 2B:
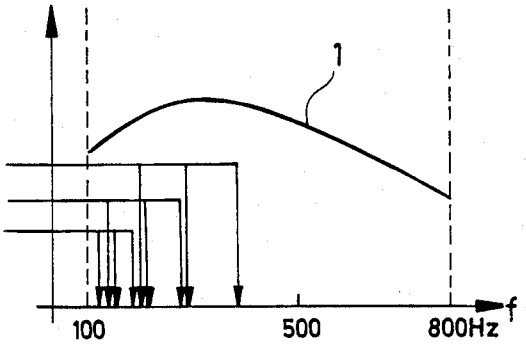

Preferably, only the first 15 to 18 harmonics are taken into account, so that the highest harmonic to be take into account for a 30 Hz excitation frequency is at 450 Hz. In FIG. 2b, by way of simplified showing, there are entered in each case only the 5th, 10th and 15th harmonics.

| | |
|---|---|
| 70 Hz × 2 = | 140 Hz |
| 70 Hz × 3 = | 210 Hz |
| 70 Hz × 4 = | 280 Hz |
| 70 Hz × 5 = | 350 Hz |
| 70 Hz × 6 = | 420 Hz |
| 70 Hz × 7 = | 490 Hz |
| 70 Hz × 8 = | 560 Hz |
| 70 Hz × 9 = | 630 Hz |

-continued

| | |
|---|---|
| 70 Hz × 10 = | 700 Hz |
| 70 Hz × 11 = | 770 Hz |
| 70 Hz × 12 = | 840 Hz |
| 70 Hz × 13 = | 910 Hz |
| 70 Hz × 14 = | 980 Hz |
| 70 Hz × 15 = | 1050 Hz |
| 95 Hz × 2 = | 190 Hz |
| 95 Hz × 3 = | 285 Hz |
| 95 Hz × 4 = | 380 Hz |
| 95 Hz × 5 = | 475 Mz |
| 95 Hz × 6 = | 570 Hz |
| 95 Hz × 7 = | 665 Hz |
| 95 Hz × 8 = | 760 Hz |
| 95 Hz × 9 = | 855 Hz |
| 95 Hz × 10 = | 950 Hz |
| 95 Hz × 11 = | 1045 Hz |
| 95 Hz × 12 = | 1140 Hz |
| 95 Hz × 13 = | 1235 Hz |
| 95 Hz × 14 = | 1330 Hz |
| 95 Hz × 15 = | 1425 Hz |

In the harmonics diagram there are defined windows of a frequency width of 6 Hz which are adjacent each other and are in the region from 100 Hz to 2000 Hz. There are thus determined (2000−100)/6=317 windows, and there are determined in each window that number of harmonics which result from the speeds of the acceleration/speed diagram at which peaks occur. For example, the 5th harmonic of the 30 Hz vibrator vibration of 150 Hz falls in the 9th window, which is defined from 148 Hz to 154 Hz. As a result of this first method step, there is obtained in each window region a number of harmonics which have fallen into the corresponding window region which is specific to the workpiece.

The window regions are now arranged in accordance with the number of harmonics which have fallen into them. In a still relatively simple method, one now selects from a very small number of windows having the highest numbers of harmonics falling into them, the corresponding base frequencies from the acceleration/speed diagram, and these speeds are used for the vibration stress relief.

In FIG. 2*b*, 1 is a curve which shows the "statistical harmonics distribution". By the "statistical harmonics distribution" there is meant the distribution which results when the same harmonics calculation is carried out as above, but not starting from the frequencies at which peaks result in the workpiece but, rather, assuming a constant step width of, for instance, 1 Hz. As shown by this curve, the statistical distribution is not constant over the harmonics region but has a maximum. An improvement in the above method is obtained if the number of harmonics in the individual window regions is standardized or weighted with respect to this statistical distribution before the window regions are arranged in their sequence.

Figure 3A:
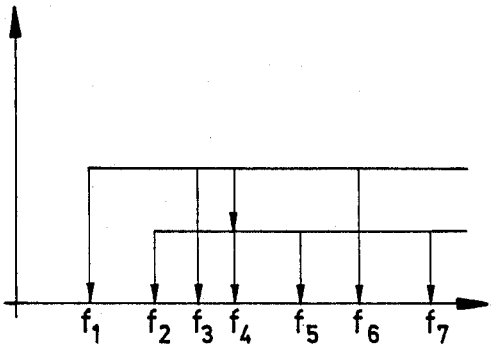
FIGS. 3a–3b is a greatly simplified showing of the association of the harmonics of two window regions in the harmonics region with the operating speeds of the vibrator which are to be selected.
Figure 3B:
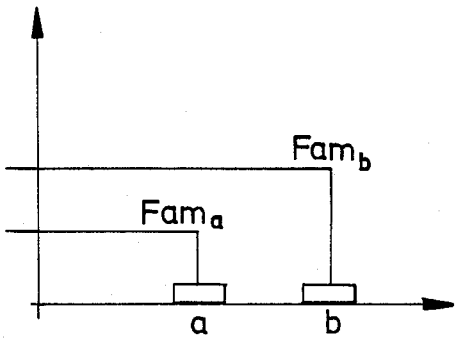

Although substantially better results as compared with the known methods are obtained already by the methods indicated above, an even better optimization of the stress relief of a workpiece is obtained by the following supplementation of the method. As described above, starting from the peaks in the acceleration/speed diagram, once again determines the numbers of harmonics in the individual window regions, standardization being possibly effected according to the statistical distribution. The sequence of the window regions is then again determined and the one hundred of highest rank are selected, for example, from the total of 317 window regions. Of these selected 100 window regions, the harmonics which have caused these window regions to be selected are subjected to a further examination. For each of these 100 window regions, those excitation frequencies from the operating range of the vibrator which have produced harmonics in the window region are combined into one family. Such a family can consist of 2 to, for instance, 14 family members. The family members for all 100 window regions selected are now placed together in the operating range of the vibrator and the sequence of the family members is determined in accordance with the number of their "degree of relationship" in a priority list. FIGS. 3*a*, 3*b* show what is meant by "degree of relationship." In FIG. 3*b*, two window regions a and b have been taken out, they belonging to the selected window regions. By the chain of arrows belonging to the window region a there are characterized those frequencies from the operating region which have produced harmonics which fell in the window region a, and the same is done with the window region b. The frequencies f2, f4, f5 and f7 belong to the family $Fam_a$ and the frequencies f1, f3, f4 and f6 to the family $Fam_b$. As can be noted from this diagram, the frequency f4 represents a special case since this frequency f4 belongs to both the family $Fam_a$ and the family $Fam_b$. These families are referred to as related because of the fact that this frequency f4 belongs to both of them. The frequency f4 has a degree of relationship while all other frequencies indicated in FIG. 3 have in each case no further degrees of relationship. One can easily imagine that in view of the large number of peaks occurring in a measurement record in accordance with FIG. 1, families with very many family members are produced and accordingly also have high degrees of relationship. In the above-indicated arrangement of the frequencies from the operating range of the vibrator, the highest priorities are given to those frequencies which have the largest number of degrees of relationship. In the simplified example of FIG. 3, the frequency f4 would be at the top place while all other (zero degrees of relationship) would be beneath it with equal rank. In practice, upon the carrying out of this selection criterion, there is obtained a greatly differentiated list with a maximum number of degrees of relationship, frequently up to ten. Those frequencies of the operating range of the vibrator which have the highest degrees of relationship in this list are now selected.

In the case of the additional selection criterion described for the "family formation," one proceeds from the finding that those frequencies in the operating range of the vibrator which are proposed for selection by the examinations in the harmonics region (window formation and selection) are the more essential because they have the highest possible number of degrees of relationship and each degree of relationship means that with the selection of only one frequency (in the above example, the frequency f4) an additional harmonics region (the two window regions a and b) is covered.

The method described above proceeded with respect to the workpiece to be subjected to the relaxation stress relief at vibration speeds calculated, from an acceleration/speed diagram in which the maxima are determined and the corresponding harmonics are then determined by calculation therefrom. However, there is also the possibility of detecting by measurement the harmonics which actually occur in the workpiece, and then subjecting these harmonics which have been determined by measurement to the selection criterion described. The detection of the harmonics by measurement can be carried out with known methods of Fourier analysis or the like. In practice it is generally sufficient to determine the harmonic distribution for only a few speeds of the vibrator since, as a result of the generally strongly non-linear excitation by the vibrator, not only are harmonics of the natural frequency produced but in addition the excitation takes place in a relatively broad frequency spectrum. If, upon the measurement of the harmonics, one establishes the corresponding harmonics spectrum for all speeds of the vibrator at which peaks occur, then the above method can be carried out in identical manner and, since upon the measurement in the harmonics range one also obtains the amplitudes of the harmonics, these amplitudes can also then be included in the optimization, the preference being given, of course, to those harmonics which lead to higher amplitudes, i.e. the harmonics are weighted according to amplitude. In practice, one can proceed in the manner that a first harmonics diagram is set up in which the density or frequency of the harmonics determined per harmonics bandwidth is plotted and a second harmonics diagram is set up in which the amplitude values are plotted. By interrelating these two diagrams, for instance by multiplication of the values of the two diagrams lying at the same frequencies, one obtains a third diagram which can be taken as basis for the further evaluation.

If, to be sure, no acceleration/speed diagram is plotted upon the frequency analysis, the above-described optimization can, of course, not be carried out by determination of the "degree of relationship." It is advisable in such a case to use this criterion of the measured amplitudes of the harmonics.

Instead of the acceleration/speed diagram customarily used in practice, one can, of course, also plot an amplitude/speed diagram which takes into account on the abscissa the actual amplitude deflections of the workpiece instead of the acceleration values. This diagram is very similar to the acceleration/speed diagram. A somewhat different diagram is the distortion factor/speed diagram. The distortion factor can be defined by the following formula:

$$K_{(d)} = \frac{\sqrt{\sum_{K=2}^{L} X^2_{(k)}}}{X_{(4)}}$$

In this formula:

$X_{(1)}$ is the amplitude of vibration at the excitation fundamental frequency, $X_{(k)}$ is the amplitude of oscillation at the kth harmonic of the fundamental frequency L is the limitation number as whole number from $f_{(max)}/F_{(j)}$, in which $f_{(max)}$ is the uppermost limit of the harmonic region defined (in the above example, 2000 Hz), and $F_{(j)}$ is the specific fundamental frequency of the excitation.

The distortion factor can be obtained through the analysis of the frequency spectrum, but also by simple measurement means. Frequency spectrum analysis gives essentially the harmonics portion of a vibration in relationship to the fundamental portion, which can be realized directly by a suitable filter arrangement which provides a limitation for the above example at 100 Hz. As compared with the acceleration/speed diagram, the distortion factor/speed diagram has the advantage that it does not have as strong a rise towards higher frequencies (even without resonance peaks the acceleration/speed diagram rises as the square of the speed.

I claim:

1. A method of operating a vibrator for the stress relief of workpieces in which the workpiece is subjected to vibrations at selected speeds of the vibrator and in which the selection of the speeds of the vibrator is taken from a measurement which reproduces the vibratory behavior of the workpiece upon excitation by the vibrator within its operating range, characterized in that for the individual speeds of the vibrator within its operating range, there are determined, within a defined harmonics region the harmonics corresponding to those vibrations in the operating range in which resonances or similar stable states of vibration occur and that, as a criterion for the stress relief of the workpiece, there are selected those speeds which cause the higher numbers of harmonics in said defined harmonics region.

2. A method according to claim 1, characterized by the fact that the harmonics of the vibrations at the selected speed which are in said defined harmonics region are determined by calculation.

3. A method according to claim 1, characterized by the fact that the harmonics produced in said defined harmonics region upon excitation at the selected speeds within the operating range of the vibrator are determined by measurement.

4. A method according to claim 3, characterized by the fact that as additional criterion for the selection of the speeds the amplitudes of the harmonics are used in a manner such that the numbers of the harmonics in the defined harmonics region are evaluated with respect to their corresponding amplitudes.

5. A method according to any of claims 1 to 4, characterized in that, within the harmonics region, window regions of the frequency range are defined, the harmonics falling into these window regions are counted, and, for the determination of the numbers of harmonics, there are selected those window regions which have the largest number of harmonics.

6. A method according to claim 5, characterized in fact that for the harmonics from each selected window region there are taken those speeds from the operating range of the vibrator which produced said harmonics and that the criterion for selection of the speeds of the vibrator are those which have produced harmonics in a larger number of selected window regions.

7. A method according to claim 6, characterized in that the speeds selected in sequence are those that have values that produced harmonics in the sequence of the largest number of selected window regions toward the smaller.

8. A method according to claim 7, characterized in that for the selection of a next speed the same criterion is used, but with the exclusion of those harmonics which are already determinative for the selection of all preceding speeds.

9. A method according to claim 1, characterized in that for the determination of the resonances or similar stable vibrations or harmonics, the acceleration values or distortion factors which occur on the workpiece are taken as a basis.

10. A method according to claim 1, characterized in that the vibrator operating range is from about 20 Hz to 100 Hz and the harmonics region is from about 100 Hz to 2000 Hz.

11. A method according to claim 4, characterized in that the harmonic frequencies and their corresponding amplitudes are used to form a harmonics density diagram and the selection criterion is the numbers of harmonics in said defined harmonics region weighted by their amplitudes.

12. A method according to claim 5, characterized n that a statistical distribution of harmonics using a constant frequency step is calculated and the selection criterion is the number of harmonics in said defined harmonics region weighted by the statistical distribution.

* * * * *